US009264798B2

(12) United States Patent
de Roo

(10) Patent No.: US 9,264,798 B2
(45) Date of Patent: Feb. 16, 2016

(54) DUAL CARTRIDGE DIRECTIONAL MICROPHONE

(75) Inventor: Dion Ivo de Roo, Voorburg (NL)

(73) Assignee: SONION NEDERLAND B.V., Amsterdam (NL)

( * ) Notice: Subject to any disclaimer, the term of this patent is extended or adjusted under 35 U.S.C. 154(b) by 446 days.

(21) Appl. No.: 13/555,550

(22) Filed: Jul. 23, 2012

(65) Prior Publication Data

US 2013/0028451 A1 Jan. 31, 2013

Related U.S. Application Data

(60) Provisional application No. 61/513,490, filed on Jul. 29, 2011.

(51) Int. Cl.
*H04R 1/30* (2006.01)
*H04R 1/38* (2006.01)
*H04R 1/40* (2006.01)

(52) U.S. Cl.
CPC . *H04R 1/38* (2013.01); *H04R 1/406* (2013.01)

(58) Field of Classification Search
CPC ..... H04R 1/38; H04R 1/342; H04R 1/32; H04R 1/345; H04R 1/347
USPC ..... 381/386, 396, 380, 328, 322, 326
See application file for complete search history.

(56) References Cited

U.S. PATENT DOCUMENTS

| | | | | |
|---|---|---|---|---|
| 2,552,878 A * | 5/1951 | Wiggins | H04R 1/38 381/173 |
| 4,063,050 A | 12/1977 | Carlson | 381/113 |
| 4,450,930 A | 5/1984 | Killion | 181/158 |
| 4,833,719 A | 5/1989 | Carme et al. | 381/72 |
| 5,068,901 A | 11/1991 | Carlson | 381/325 |
| 5,675,658 A | 10/1997 | Brittain | 381/72 |
| 5,862,234 A | 1/1999 | Todter et al. | 381/71.6 |
| 6,068,589 A | 5/2000 | Neukermans | 600/25 |
| 6,445,799 B1 | 9/2002 | Taenzer et al. | 381/71.6 |
| 6,853,735 B2 | 2/2005 | Imahori et al. | 481/418 |

(Continued)

FOREIGN PATENT DOCUMENTS

| | | |
|---|---|---|
| DE | 4307825 A1 | 9/1994 |
| EP | 1795160 | 7/2005 |

(Continued)

OTHER PUBLICATIONS

European Search Report for Application No. 12176899.8-1224, Dated Nov. 13, 2012, 3 pages.

*Primary Examiner* — Daveeta W Goins
*Assistant Examiner* — Jasmine Pritchard
(74) *Attorney, Agent, or Firm* — Nixon Peabody LLP

(57) ABSTRACT

The invention relates to a microphone (10). A first (14*a*) and a second (14*b*) diaphragm are provided in a housing (12). A first chamber (24*a*) is delimited by a first side of the first diaphragm (14*a*) and an inner surface of the housing (12). A first opening (18*a*) extends from the first chamber (24*a*) to surroundings of the microphone (10). A second chamber (24*b*) is delimited by a first side of the second diaphragm (14*b*) and an inner surface of the housing (12). A second opening (18*b*) extends from the second chamber (24*b*) to the surroundings. A common chamber (22) is delimited by a second side of the first diaphragm (14*a*), a second side of the second diaphragm (14*b*) and an inner surface of the housing (12). A third opening (20) extends from the common chamber (22) to the surroundings.

5 Claims, 2 Drawing Sheets

(56) References Cited

U.S. PATENT DOCUMENTS

| | | | | |
|---|---|---|---|---|
| 7,983,433 | B2 | 7/2011 | Nemirovski | 381/318 |
| 8,094,849 | B2 * | 1/2012 | Freels | H04R 25/658 381/322 |
| 8,189,804 | B2 | 5/2012 | Hruza | 381/74 |
| 8,660,289 | B2 * | 2/2014 | Tiscareno | H04R 1/403 381/328 |
| 2006/0088176 | A1 * | 4/2006 | Werner | H04R 25/405 381/113 |
| 2006/0159298 | A1 | 7/2006 | Dombrowski et al. | |
| 2008/0063223 | A1 | 3/2008 | Van Helteren et al. | |
| 2008/0170732 | A1 | 7/2008 | Nielsen | |
| 2010/0067730 | A1 | 3/2010 | Van Helteren et al. | |
| 2012/0255805 | A1 * | 10/2012 | van Halteren | H04R 11/02 181/199 |

FOREIGN PATENT DOCUMENTS

| | | | |
|---|---|---|---|
| EP | 2506598 | A2 | 10/2012 |
| JP | 1234000 | A | 9/1989 |
| WO | 2006083834 | | 8/2006 |
| WO | 2007115304 | | 10/2007 |
| WO | 2008054921 | | 5/2008 |

* cited by examiner

DUAL CARTRIDGE DIRECTIONAL MICROPHONE

PRIORITY CLAIM AND CROSS REFERENCE TO RELATED APPLICATIONS

This application claims priority to U.S. Provisional Application No. 61/513,490, filed on Jul. 29, 2011 which is incorporated herein its entirety.

TECHNICAL FIELD

The present invention relates to a microphone having two diaphragms and in particular to a directional microphone using one or more such microphones.

BACKGROUND

Directional microphones typically are divided into two groups: first order and second order set-ups. In a first order set-up (see FIGS. 1 and 2), sound from two spatially different inputs is picked up and processed. To obtain directionality, the sound of a first inlet is delayed after which the two input signals are subtracted. This so-called delay-and-subtract process can be performed by a processing circuit in a two microphone setup as shown in FIG. 1 or by a mechanical equivalently configured single microphone setup as shown in FIG. 2. Naturally, these set-up types may be combined, as may be seen in FIG. 3, where two directional microphones are used in a second order set-up. In the second order set-up (see FIG. 3), two microphones each pick up sound from two spatially different inputs, and the delay-and-subtract process is performed twice, once mechanical and once in circuitry. In addition, the pair of two spatially different inputs of one microphone is usually spatially different from the pair of inputs of the other microphone.

Many of today's directional microphone hearing aids utilize a two microphone approach, using two omni-directional microphones in end-fire geometry. A first-order delay-and-subtract processing creates a spatial dependent sensitivity with the maximum located directly in front. This spatially dependent sensitivity ("directionality") has proven to be beneficial for speech intelligibility in noisy environments.

A drawback of using the delay-and-subtract processing is that the sensitivity of the microphone array drops with 6 dB/oct at the low frequencies. This makes that a hearing aid utilizing two (omni-) microphone array has worse signal-to-noise ratio than that with a single microphone.

To improve the directionality of hearing aids even further and hence the speech intelligibility, hearing aid manufacturers have been working on utilizing the same delay-and-subtract processing, but now with two conventional, single-cartridge directional microphones (FIG. 3), thus constituting a second order directional set-up.

The sensitivity of single-cartridge directional microphones however drops also with 6 dB/oct for the low frequencies. This, together with the delay-and-subtract processing, makes the sensitivity of the array decrease very rapidly with 12 dB/oct for the low frequencies. As such, second-order directional microphone arrays have a very poor signal-to-noise ratio.

The very low signal(-to-noise ratio) of second-order directional microphone arrays has a negative side effect. It makes the array extremely sensitive to external noise sources, like wind noise or mechanical vibrations. These external noise sources can 'easily' deteriorate the directionality and/or cause loud annoying sounds.

This is why hearing aids are rarely equipped with a second-order directional mode. And if used, the working range of a second-order directional mode is limited to the high frequency range only, i.e. ca>2 kHz.

As such, it is desirable to have a second-order directional microphone array with improved signal-to-noise ratio as well as one which is less susceptible to mechanical vibrations. Also, it is desirable to provide a microphone which is less sensitive to vibration etc.

SUMMARY

In a first aspect, the invention relates to a microphone comprising a housing, a first and a second diaphragm, a first chamber, and a second chamber. A first and a second diaphragm is provided in the housing. Each diaphragm has a first side and a second side. The first chamber is delimited at least partly by the first side of the first diaphragm and an inner surface of the housing. A first opening extends from the first chamber and to surroundings of the microphone. The second chamber is delimited at least partly by the first side of the second diaphragm and an inner surface of the housing. A second opening extends from the second chamber and to the surroundings. A common chamber is delimited at least partly by the second side of the first diaphragm, the second side of the second diaphragm and an inner surface of the housing. A third opening extends from the common chamber and to the surroundings.

In the present context, a microphone is an element adapted to convert a sound signal into an electrical and/or optical signal. Naturally, the signal may be analogue, digital or conform to any other form, protocol and/or shape.

The present microphone housing comprises at least the first, the second and the common chamber. Usually, the housing is a single housing structure in which inner surfaces thereof take part in the definition of the chambers and outer parts thereof take part in defining an outer surface of the housing. Naturally, multiple housing structures may be used in which an outer surface of an outer housing structure defines at least part of an outer surface of the microphone, where inner surface parts of another, inner, housing take part in defining the chambers.

The inner surfaces or surface parts taking part in the defining of the individual chambers usually do not overlap, as the chambers usually are not connected to each other. It is noted that pressure compensation openings may be provided so as to allow pressure compensation to take place in order to relieve stress of diaphragms, but such pressure compensation takes place via openings so small that no sound is transported from one chamber to the other via such openings.

The present microphone may be implemented as a miniature microphone with a housing size of no more than 5×5×5 mm, such as 5×5×4 mm, such as 3.5×3.5×1.5 with the smaller dimension perpendicular to a plane of one or both diaphragm(s). In the present context, a diaphragm is a very thin and usually flat element that is movable by the sound entering the opening(s).

Even though not specifically mentioned, a microphone has means for converting movement, usually in a direction perpendicular to a main surface or plane of the diaphragm, of the diaphragm into an output signal. Different types of such means are known, such as MicroElectrical-Mechanical System (MEMS) or electro condenser (electret) systems, and amplifiers, filters, processors or the like may be used for adapting the signal before, or even after, output thereof.

Preferably, the first and second diaphragms are parallel, such as with the second sides facing each other.

Preferably, the first chamber is not delimited by the second diaphragm.

Also, preferably, the second chamber is not delimited by the first diaphragm.

The first opening provides a gas/sound transport between the first chamber and the surroundings of the microphone. In this context, the surroundings are a space provided outside of the housing. This space may be provided inside a larger housing, such as a hearing aid shell, in which the microphone is positioned, but preferably, the surroundings are those from which the sounds emanate or are received. The openings then may also be openings through additional housings, if the microphone has multiple housings or is positioned within an outer housing.

Sound entering the first chamber through the first opening thus affects the first diaphragm but not, at least to any significant degree, the second diaphragm, and sound entering the second chamber through the second opening thus affects the second diaphragm but not, at least to any significant degree, the first diaphragm. Sound entering the common chamber affects both diaphragms.

In a preferred embodiment, the first and second openings are provided in one side of the housing and the third opening in another side, such as a side opposite to the one side, of the housing. In this manner, providing individual sound to the openings is made easier.

In that or another preferred embodiment, the microphone further comprises a first sound guide adapted to transport sound from a first sound inlet to both the first and second openings. In this manner, and especially if there is no substantial delay in sound entering the first sound guide and the first chamber and sound entering the first sound guide and the second chamber, the same sound (especially the phase but also the amplitude) enters the first and second chambers and affects the first and second diaphragms in the same manner (preferably identically in phase and amplitude). It is noted that the movements of the first and second diaphragms may be opposite to each other.

Then the microphone may further comprise a second sound channel from the third opening and to a second sound receiving opening, and an acoustic resistance in one of the first and the second sound channels.

In this manner, a directional microphone may be obtained as the sound from the first sound receiving opening and that from the second sound receiving opening is forwarded to the different chambers separated by the diaphragms. Thus, as is known in the art, the signals from each diaphragm will relate not only to the sound received but also the direction from which it is received.

In a preferred embodiment, the microphone further comprises a first back plate positioned adjacently to the first diaphragm and a second back plate positioned adjacently to the second diaphragm.

In that situation, the distance between a diaphragm and a back plate will vary due to the movement of the diaphragm, and a signal relating to this distance or distance variation may be obtained, as this signal will relate to the sound entering the chamber(s) and thus affecting the diaphragm.

Then, in one situation, the first back plate may be positioned in the first chamber and the second back plate in the second chamber. Alternatively, the first back plate and the second back plate may be positioned in the common chamber. In both situations, vibration damping or vibration compensation may be obtained in that vibration of the microphone, along a direction perpendicular to one or both diaphragms, will act to move the diaphragm in the same manner as sound would, but the movement of the microphone will cause the same movement of the diaphragms. And due to the relative positioning of the back plates and the corresponding diaphragms, one distance will increase and the other decrease. These contributions may be brought to cancel out.

In one situation, the microphone further comprises a signal processor connected to the diaphragms and/or the back plates and being adapted to output a signal corresponding to a sound fed into the first, second and third openings.

In one situation, the signals from the two diaphragms and/or back plates are added, such as using the processor. Thus, vibration/movement of the microphone will be cancelled as this will cause different, but complementary, signals in the two backplates/diaphragms, whereas the incoming sound may cause the same signals which are then simply added and then amplified. The signal strength corresponds with the distance between the diaphragm and backplate of each diaphragm-backplate pair. An increasing distance will make the signal drop, and a decreasing distance will make the signal increase. Adding these signals will, such after a suitable adaptation of the signals, make these contributions cancel out. The sound entering the chambers, however, will also affect the diaphragms and will be represented in the resulting signal.

Naturally, this processor may be positioned at any position within or outside the microphone. In a preferred embodiment, the processor is positioned in the common chamber and is electrically connected to the closest ones of the diaphragms and the back plates.

Another aspect of the invention relates to a hearing aid comprising one or more of the microphones according to the first aspect. Adding more microphones may be desired in order to obtain a better sound detection and/or directional capabilities. This hearing aid may comprise a so-called Behind-The-Ear part in which one or more of these microphones are provided. This has the advantage that directional sound reception may be facilitated through openings in a housing of this BTE part.

A last aspect of the invention relates to an assembly comprising a plurality of the microphones according to the first aspect. This assembly may relate to sound recorders or other equipment adapted to record sound but which may be exposed to vibration or the like.

The above summary of the present invention is not intended to represent each embodiment or every aspect of the present invention. The detailed description and Figures will describe many of the embodiments and aspects of the present invention.

BRIEF DESCRIPTION OF THE DRAWINGS

In the following, preferred embodiments of the invention will be described with reference to the drawing wherein.

Figure 1:
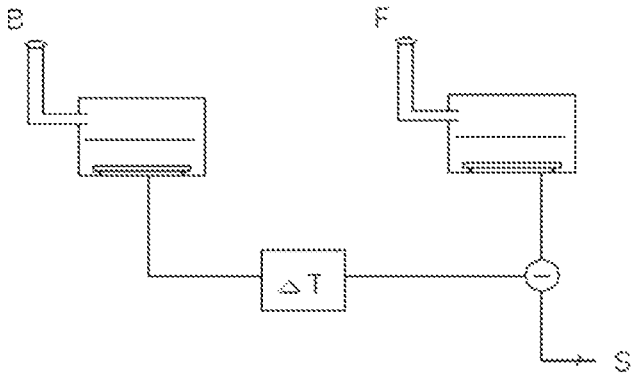
Fig. 1 PRIOR ART
FIG. 1 illustrates a prior art directional microphone using two omni-directional microphones in a first order set-up.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 illustrates the prior art use of two omni-directional microphones in a 1$^{st}$ order directional setup. A first microphone picks up sound at port F (front with regard of sound coming towards the front of the user), a second microphone picks up sound at port B (located backwards in relation to port F).

Sound picked up by the second microphone is delayed, and the signals are subtracted. The resulting signal has a directional characteristic, as sound coming from the left is cancelled out, while sound coming from the right is not. The delay T and subtraction are both electronically performed.

Figure 2:
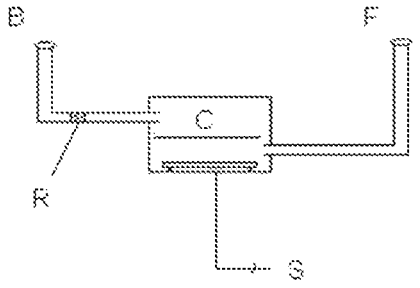
Fig. 2 PRIOR ART
FIG. 2 illustrates a prior art directional microphone using a directional microphone in a first order set-up.

FIG. 2 illustrates a prior art directional microphone in a 1$^{st}$ order directional setup. In this setup, an acoustic resistance R (e.g. a wire mesh or other means) provides the delay of the signal. The volume above the membrane constitutes a compliance C which in combination with the resistance R constitutes the time delay constant T.

As the membrane undergoes the pressure from both sound ports, the pressures are subtracted and the membrane picks up a differential signal. So delay and subtraction are performed acoustically.

Figure 3:
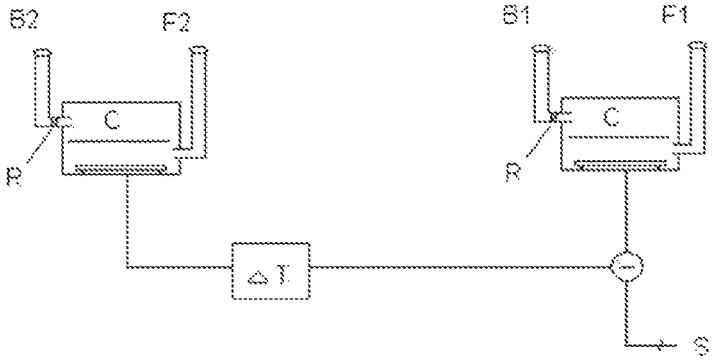
Fig. 3 PRIOR ART
FIG. 3 illustrates a prior art directional microphone using two directional microphones in a second order set-up.

FIG. 3 illustrates the prior art use of two directional microphones in a 2$^{nd}$ order directional setup. In this setup, for each pair, the F and B port are located close to each other; while the pairs of ports F1 and B1 and F2 and B2 are located apart from each other. Each microphone only picks up a small/low differential signal, but the subsequent electronic delay & subtract provides an increased directional sensitivity. But due to the low signals, the S/N is worse.

The movement of the membrane induces a voltage change that constitutes the signal.

Figure 6:
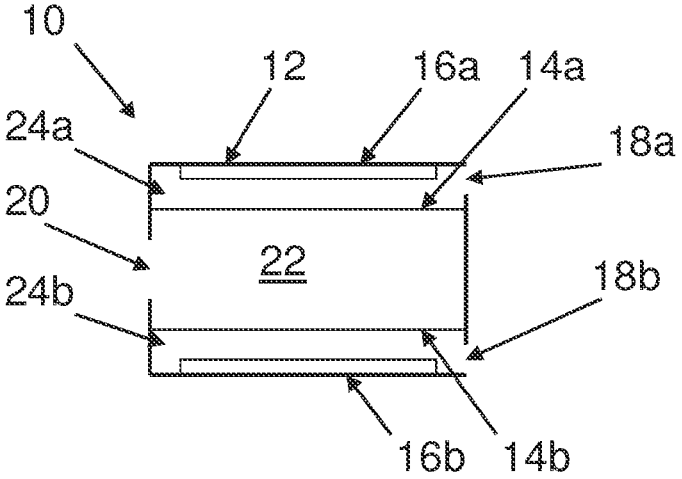
FIG. 6 illustrates a preferred embodiment of the dual cartridge microphone of the invention.

FIG. 6 illustrates a microphone 10 according to the invention. This microphone 10 has a housing 12 wherein two diaphragms 14*a*/14*b* are positioned. The diaphragms 14*a*/14*b* divide the inner space of the housing 12 into three spaces: (i) a common chamber 22 from which an opening 20 opens to the outside of the microphone 10, (ii) a first chamber 24*a* which is defined by the diaphragm 14*a* and an inner part of the housing 12 and from which an opening 18*a* opens to the outside of the microphone 10, and (iii) a second chamber 24*b* which is defined by the diaphragm 14*b* and an inner part of the housing 12 and from which an opening 18*b* opens to the outside of the microphone 10. In relation to each diaphragm 14*a*/14*b*, a back plate 16*a*/16*b*, respectively, is provided, as is usual in the art.

Compared to the prior art of FIGS. 1-3, the present microphone 10 has the advantage that the effects of vibrations may be cancelled out.

Figure 5:
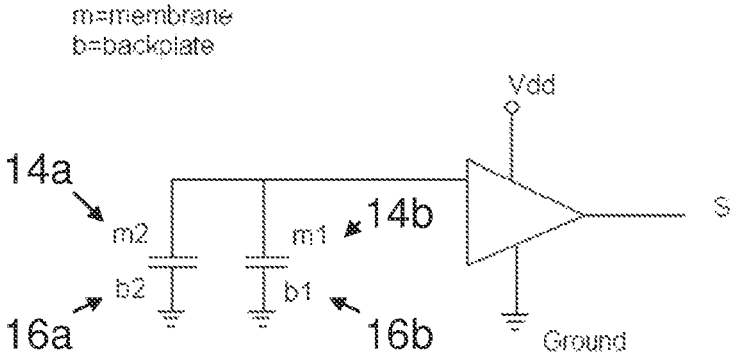
FIG. 5 illustrates the electrical connections of the microphones of FIG. 4.

A suitable circuit for the microphone 10 is illustrated in FIG. 5 in which the signals/voltages between the diaphragms 14*a*/14*b* and the back plates 16*a*/16*b* are summed and then amplified. The summing will cancel out any effect of vibration in that the two diaphragm/back plate assemblies are mirrored. An upward movement of the microphone 10 will make one diaphragm 14*a* move toward the backplate 16*a*, while the other diaphragm 14*b* will move away from the backplate 16*b*. During a downward movement of the microphone 10, the opposite occurs. Downward movement will make one diaphragm 14*a* move away from the backplate 16*a*, while the other diaphragm 14*b* will move toward the backplate 16*b*. In each case, the movement results in two signals with the same amplitude, but in counter phase which cancel after summation. Thus, the inertia of the two diaphragms is put to use during microphone vibration. Thus, this microphone 10 generally is less sensitive to vibration.

Naturally, the circuit of FIG. 5 may be altered. The effect that the movements of the diaphragms is to cancel out may be obtained in a number of manners. If the two back plates 16*a*/16*b* are both positioned in the common chamber 22, the same effect is immediately obtained.

However, as sound pressure is introduced into the chambers 24*a*, 24*b*, the diaphragms will move both either away or towards the backplates depending on whether the pressure in the chambers 24*a*, 24*b* is higher or lower than the pressure in chamber 22. This results in two signals with the same amplitude and in phase, so the signals add up after summation. The chambers 24*a*, 24*b* are connected to the same sound inlet and thus experience the same pressure.

Also, this microphone 10 may be used as a directional microphone in a 1$^{st}$ order directional setup of the type seen in FIG. 2. By providing an acoustic resistance R (e.g. a wire mesh or other means) for providing a delay of the signal to one of the chambers 22 or 24*a*/24*b* the directional sensitivity of the microphone can be adjusted. The directional sensitivity can be plotted as a polar pattern showing the variation in sensitivity 360 degrees around a microphone, with 0 degree usually representing the front of the microphone. For example, for a bi-directional microphone the angle at which the sensitivity is zero, is 90 degrees (and 270 degrees) and the angle at which the sensitivity is maximum is 0 degrees and 360 degrees. The zero sensitivity angle is related to the delay introduced by the acoustic resistance.

Figure 4:
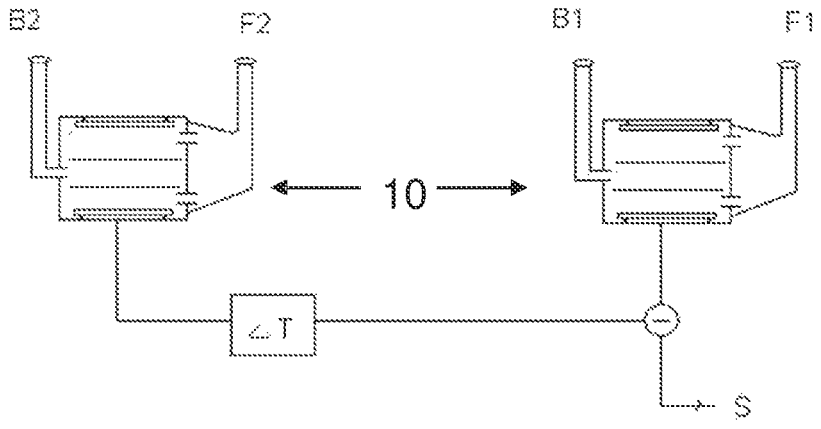
FIG. 4 illustrates a directional microphone using two directional microphones according to FIG. 6 in a second order set-up.

Also, as is seen in FIG. 4, the microphone 10 may be used in a second order directional setup of the type seen in FIG. 3 where, however, the directional microphones are replaced by the dual cartridge directional microphones 10 of FIG. 6. For each microphone 10 the openings 18*a* and 18*b* are connected by one spout to the same front port F, whereas the shared volume is connected to the single back port B.

As shown, each microphone 10 can be provided with an acoustic resistance in one of the sound guides as explained above for the (single cartridge to adjust the polar pattern of microphone set-up.

In relation to FIG. 5, in each microphone, each diaphragm 14*a*/14*b* preferably is connected by a lead to the same input of a pre-amplifier that amplifies the signal. Thus, the leads may simply be connected to each other. So, the signals of each diaphragm 14*a*/14*b* may simply be added to cancel out vibration.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

The invention claimed is:

1. A microphone comprising:

a housing;

a first diaphragm and a second diaphragm provided in the housing, each diaphragm having a first side and a second side, the first and second diaphragms being parallel, the second sides of the first and second diaphragms facing each other;

a first chamber delimited at least partly by the first side of the first diaphragm and an inner surface of the housing;

a first opening from the first chamber and to surroundings of the microphone;

a second chamber delimited at least partly by the first side of the second diaphragm and an inner surface of the housing;

a second opening from the second chamber and to the surroundings;

a common chamber delimited at least partly by the second side of the first diaphragm, the second side of the second diaphragm and an inner surface of the housing;

a third opening from the common chamber and to the surroundings;

a first sound guide adapted to transport sound from a first sound inlet to the first and second openings;

a first back plate positioned adjacently to the first diaphragm; and a second back plate positioned adjacently to the second diaphragm, wherein the first back plate is positioned in the first chamber and the second back plate is positioned in the second chamber or the first back plate and the second back plate are positioned in the common chamber.

2. A microphone according to claim 1, further comprising: a second sound guide from the third opening and to a second sound receiving opening, an acoustic resistance in one of the first and the second sound guides.

3. A microphone according to claim 1, further comprising a signal processor connected to the diaphragms and/or the back plates and being adapted to output a signal corresponding to a sound fed into the first sound inlet and the opening.

4. A hearing aid comprising one or more of the microphones according to claim 1.

5. An assembly comprising a plurality of the microphones according to claim 1.

* * * * *